US005494519A

United States Patent [19]

Jeffrey, Jr.

[11] Patent Number: 5,494,519

[45] Date of Patent: Feb. 27, 1996

[54] WINDOW FRAME SELF-SUPPORTING WINDOW PANE PAINT SHIELD

[76] Inventor: Louis R. Jeffrey, Jr., 50 Gloucester Rd., Summit, N.J. 07901

[21] Appl. No.: 237,042

[22] Filed: May 2, 1994

Related U.S. Application Data

[63] Continuation-in-part of Ser. No. 173,154, Dec. 23, 1993, Pat. No. 5,354,377.

[51] Int. Cl.[6] ..... B05C 21/00

[52] U.S. Cl. ..... 118/504; 118/505

[58] Field of Search ..... 118/504, 505, 118/213, 301, 406; 16/1 R; 150/154, 168; 248/200.1, 188.5; 15/248.1, 248.2; 427/282; 451/457

[56] References Cited

U.S. PATENT DOCUMENTS

| | | | |
|---|---|---|---|
| 2,436,800 | 3/1948 | Fryzel et al. | 248/200.1 |
| 2,517,220 | 8/1950 | Lister | 118/504 |
| 3,651,783 | 3/1972 | Ribbecke | 118/505 |
| 4,196,692 | 4/1980 | Vanstrom | 118/504 |
| 4,235,192 | 11/1980 | Brubaker | 118/504 |
| 4,411,219 | 10/1983 | Keith et al. | 118/505 |
| 4,697,544 | 10/1987 | Stevens et al. | 118/504 |
| 5,109,793 | 5/1992 | Ballejos | 118/505 |

FOREIGN PATENT DOCUMENTS

| | | | |
|---|---|---|---|
| 0930073 | 2/1948 | France | 248/200.1 |
| 0219262 | 7/1924 | United Kingdom | 248/200.1 |
| 0236327 | 7/1925 | United Kingdom | 248/200.1 |

*Primary Examiner*—Laura Collins
*Attorney, Agent, or Firm*—William F. Hough

[57] ABSTRACT

A framed window pane paint hand-held semi-flexible plastic pane-shield positionable against a substantially right-angled corner of a window frame, the pane-shield having a linear edge continuous with a bottom surface of its flange. The linear edges of the hand-held pane-shield intersect at up to a ninety-degree angle or more. The pane shield's bottom surface angles upwardly from its linear edge at an angle of about 20 degrees relative to a mounted window pane surface. The intersecting flanges and their linear edges are each about 4 or more inches in length and each is sufficiently flexible as to expand, relative to the other, to sharply engage and flushly fit along a window frame edging having an edging corner that ranges from slightly less than 90 degrees possibly to greater than 90 degrees.

6 Claims, 4 Drawing Sheets

WINDOW FRAME SELF-SUPPORTING WINDOW PANE PAINT SHIELD

This is a continuation-in-part patent application of U.S. patent application Ser. No. 08/173,154 filed Dec. 23, 1993, issued on Oct. 11, 1994 as U.S. Pat. No. 5,354,377 by the same inventor.

This invention relates to a novel portable and self-supporting mountable framed window pane paint shield mountable between diagonally opposite right-angle frame corners of windows of varying sizes.

BACKGROUND OF THE INVENTION

In a preliminary prior art search, no relevant prior art was located, with regard to the novel aspects and objects of the present invention. The sole patent located that is of interest but directed to divergent problems and objects and structures a part of that invention, is the U.S. Pat. No. 4,196,692 to Marc Q. Vanstrom directed to a large window-pane edges-shielding structure of numerous diverse parts inclusive of manually holding in position, for adjustable revolvable lever for alternately extending or contracting concurrently collapsable pivoted arms each carrying a separate right-angled flat-faced and flatly-mounted corner shield, and requiring continued manual holding of the device during any painting operation for vertically-mounted windowpanes. Likewise U.S. Pat. No. 5,109,793 to Balllejos is directed to flat-faced and flatly-mounted oppositely spring-biased window pane shields each having solely one linear edge, for positioniong between opposite linear frame edges of a window frame, for fixedly-positioning the shield; nothing is stated relative to having any self-supporting feature.

During the painting of frame-trim around a mounted window pane, a painstaking effort and steady hand as well as reasonable care and undivided attention all are required to avoid the accidental painting of adjoining surfaces of the mounted window pane. While prior art devices such as the afore-stated prior art and/or such as a mere hand held straight-edge have been inadequate possibilities, nothing heretofore has been available to effectively and quickly and easily free both hands by utilization of easily and quickly mountable self-supporting paint shields. Also none have been constructed to effectively avoid paint smearing the pane during shifting and/or removing of the shield from contact with the glass during or after completion of painting. Heretofore one of the hands and divided attention of the painter have been required with heretofore window pane paint shield(s) especially for corner areas during the painting of the window frame or framing trim. Such, likewise is the situation for the above-noted bulky and heavy prior art flat-face flatly positionable device. Heretofore, therefore, painting the frame-trim around windows has been one of the more time consuming tasks of industrial and consumer home painting. A relatively large amount of time is required to cover a small area when painting window frame-trim, whereas regular painting of flat faces requires a relatively small amount of time to cover a large area. Heretofore it has been virtually impossible to speedily paint window frame trim free-handedly without having some of the paint spill or run onto the framed window pane adjacent surface and/or smear of paint onto the window pane at and/or beneath the edge(s) of manually-held paint shield caused by shifting during painting and/or during removal of a window pane prior art flat-faced and/or flatly-positioned paint shield during and/or after painting of the adjacent window frame trim. This required additional effort to promptly requiring clean-up paint from the affected area(s). An optional approach has been a time-consuming taping of the adjacent windowpane areas, which after the trim or frame painting nevertheless smears the pane area(s) during the removal of the tape after the window areas, and/or leaves unsightly adhesive debris on the surfaces of the window pane—requiring further tedious cleaning while avoiding mutilating the freshly painted frame surfaces. Conventional use of razor blade(s) during such clean-ups includes the real hazards and possibilities of cutting the finger of the cleanup person.

A problem in otherwise masking an entire window involves the difficulty of cutting a close and non-obstructive shaped shield, with no standardized shield being available for most windows that normally vary considerably in sizes.

Accordingly, there is need for a working accessory that largely overcomes such plaguing difficulties and prolonged arduous work—whether done by a professional or by an amatuer.

OBJECTS OF THE INVENTION

Accordingly, the main objects of the invention include overcoming and/or avoiding of the problems and difficulties stated above.

Another object is to provide a mechanical device that will self-support itself on most window frames of diverse rectangular or squared shape(s), enabling speedy and optimal painting of window frames devoid of aforestated problems and difficulties.

Another object is to avoid and/or minimize accumulating and/or smearing paint on a window pane beneath heretofore flat-faced and/or a flatly-mounted face of window frame-engaging edge(s) of a flat-faced and/or flat-faced supportable window shield during or after the frame trim painting.

Another object is to provide a windowpane shield device that will avoid accidental painting of adjacent panes during painting of frame trim.

Another object is to provide a window pane shield device of light weight and/or of simple structure, and easily mountable and maintained before, during and after the use thereof.

Another object is to provide such a device from low cost materials and/or at low cost of manufacture, enabling the providing of the device at economical and/or attractive price(s).

Another object is to provide such a paint protector of framed window panes and/or corners thereof, which are easily movable from one pair diagonally-opposite corners to a remaining pair of diagonally-opposite corners and/or from a completed painted window frame to a next remaining unpainted window frame.

Another object is to make possible the neat painting of window frames by either a professional or nonprofessional, at a speedy rate while achieving a professional job devoid of messy or arduous efforts before, during and/or after the painting, by use of the device of the present invention.

Other objects become apparent from the preceding and following disclosure.

SUMMARY OF THE INVENTION

Two characteristics that all rectangular and/or square windows have in common is that their opposite corners are in a straight line with respect to each other and each of the corners form a right or ninety degree angle with respect to the adjacent framing window structure, normally referred to as window frame and/or window trim. While the opposite window corners are always diagonally opposite to each other, their relative angles change so that the shape of the window frame changes. As a result, the first and second paint shields preferably pivot to compensate for such changing angles between diagonally opposite corners. These characteristics enable the present invention to form the cornerstone, i.e. the heart of the basis for shielding a large part of corner portions of adjoining window panes substantially concurrently, while as set forth in foregoing objects, freeing the hand not holding the paint brush for other needed and/or desired use(s). Accordingly the invention provides also for additionally concurrently the hand-holding of a handled accessory of the present invention enabling concurrently paint-shielding a remaining intermediate corner's corner pane portion located between the diagonally opposite window pane corners shielded by the self-supporting main device of this invention. Additionally, however, a principal concern and object of any paint shield, is to avoid smearing paint on the window pane adjacent to the frame trim. This is made possible by the same essential and critical element, namely the non-flat angle or pitch of the lower face of the shield as the right angled edges thereof are pressed firmly and self-supportingly against the frame trim structure immediately adjacent the windowpane itself.

Accordingly, broadly the invention may be described as a portable window paint shield device that includes separate first and second paint-shield structure(s) (and mechanisms thereof) for being pressed self-supportingly against an adjoining windowpane portions and spring-biasing structure(s) (and mechanisms thereof) for biasing the first and second paint-shield structure(s) (and mechanisms thereof) in substantially opposite directions toward and against the diagonally opposite corners when the first and second right-angled outer edges are pressed against the window pane portions.

The separate first and second paint-shield structure(s) (and mechanisms thereof) are adapted to be concurrently pressed self-supportingly against and between diagonally opposite frame trim corners onto adjoining window pane portions. Having done so, the first and second paint shield structure(s) (and mechanisms thereof) are self-supportingly wedged between frame diagonally opposite corners when bias mounted against and fitted into diagonally opposite corners of an adjoining framing window frame. Thereupon, the adjoining framing window frame trim at diagonally opposite corners thereof is protectable against accidental painting and/or smearing adjoining window pane portions at at-least the diagonally opposite corners when shielded from a paint-carrying paint brush by the first and second paint-shield structure(s) (and mechanisms thereof) during painting of at least one of the diagonally opposite corners or thereafter during removal of the paint shields. The first paint-shield structure(s) (and mechanisms thereof) include(s) shaped structure forming a first right-angled outer edge. Also the second paint-shield structure(s) (and mechanisms thereof) form(s) a second right-angled outer edge. The first and second right-angle outer edges each have an outwardly-directed edge of a predetermined thin thickness sufficiently thin as to substantially not obstruct a paint brush when the outwardly-directed edges and the first and second right angle corners are pressed concurrently against said diagonally opposite corners's window frame trim and against a window pane framed by the window frame. Each of the first and second right-angled outer edges have a right linear edge portion extending at a right angle to a left linear edge portion. Each of the first and second paint-shield structure(s) include first and second interconnected right and left flanges extending at a right angle to one-another. The right flange of each of the first and second paint-shield structure(s) has/have a right bottom face that includes a right lower edge portion angled downwardly toward and culminating as the right linear edge portion. The left flange of each of the first and second paint-shield means has a left bottom face that includes a left lower edge portion crtically angled downwardly toward and culminating as said left linear edge portion. Relative to an imaginary plane extending along each of and between the right and left linear edge portions, there is formed an angle with each of said right and left lower edge portions. That angle ranges critically but broadly from not less than about 5 degrees up to about 55 degrees. The at-least minimum angle of 5 degrees assures two essential features, namely the required necessary leverage and resulting force thereof of the shield in its spring-biased pressure downwardly toward the adjoining surface of the windowpane at and concurrently against the window frame trim, with a result of being both (1) self-supporting devoid against potential dropping-off or being jarred-off by accidental incidental contact against the shield(s), and (2) preventing any significant amount of paint accumulation on any significant amount of bottom-face of the shield itself—such that probability and/or possibility of accidental smearing paint across the face of the window pane is substantially eliminated or at-least significantly reduced. Accordingly, the minimum angle is critically required for the present inventive device above and hereinafter described, with preferred and optimal results being attained within the preferred angular degree(s) range hereinafter stated below.

The spring-biasing structure(s) (and mechanisms thereof) when mounted, bias the first and second paint-shield structure(s) (and mechanisms thereof) in substantially opposite directions oppositely toward and against-the diagonally opposite corners of a window frame, when the first and second right-angled outer edges are pressed against the window pane portions. As a result thereof, the first and second paint shield structure(s) (and mechanisms thereof) are self-supporting when wedge-mounted between the diagonally opposite corners of the window frame.

In a first preferred embodiment as an improvement on the aforestated broad generic invention, the spring biasing structure(s) (and mechanisms thereof) includes a first member, separately a second movable member, a spring-retaining support structure, and biasing spring structure. By this greater combination of recited elements, design and function is enhanced significantly, as evidence by substantial research heretofore conducted, especially with regard to avoidance of smearing and assurance of sufficient required biasing force by the biasing spring structure to assure good wedge-retention during its self-holding mounting without being continuously held by the human hand nor otherwise, freeing the painter to concentrate on speedy and careful painting of the window frame trim, and not readily dislodged by accidental striking.

The first member forms as a part thereof, a first linearly-elongated channel and forms a first end having a first opening continuous with the first linearly-elongated channel.

The first movable member is movably mounted and at-least partially retainable within the first linearly-elongated channel and within the first opening, and is mounted on one of the first and second paint-shield structure(s) (and mechanisms thereof). The movable member is movable alternately in a direction of and a direction away from the one of the first and second paint-shield structure(s) (and mechanisms thereof).

The spring-support structure is mounted on the first member.

The biasing spring structure is mounted within the first lineally-elongated channel, and is expandably mounted between the spring support structure and the movable member sufficiently to bias the movable member and the one of the first and second paint-shield structure(s) (and mechanisms thereof) in a direction away from the remaining other one of the first and second paint-shield structure(s) (and mechanisms thereof).

In a second preferred embodiment as an improvement on the first preferred embodiment, the first member is mounted on the remaining one of the first and second paint-shield structure(s) (and mechanisms thereof) such that the spring biasing structure(s) (and mechanisms thereof) biases the one of the first and second paint-shield structure(s) (and mechanisms thereof) axially away from the remaining other one of the first and second paint-shield structure(s) (and mechanisms thereof). This particular arrangement as the second preferred embodiment, is thus critical to more optimal results in achieving the aforestated objects, particularly with regard to being self supporting—devoid of risk of falling off by virtue of its own weight and/or as a result of accidental pushing or striking thereof during a painting the window frame trim.

In a third preferred embodiment, as an improvement on the second preferred embodiment, the first movable member is pivotally mounted on the one of the first and second paint shield structure(s) (and mechanisms thereof), and the first member is pivotally mounted on the remaining one of the first and second paint-shield structure(s) (and mechanisms thereof) such that the first right-angled outer edge and the second right-angled outer edge conform to matched right angle shapes of the diagonally opposite corners, enhancing the utility of the aforestated shielding device when taken in combination with aforestated elements.

In a fourth preferred embodiment, as an improvement on the second preferred embodiment, the spring-support structure and the first member jointly include a spring-pressure adjustment structure(s) (and mechanisms thereof) for intermittently manually increasing and alternately decreasing spring biasing pressure serving to bias the first and second paint-shield structure(s) (and mechanisms thereof) from one another. The spring-pressure adjustment structure(s) (and mechanisms thereof) include alternate lock positions for varying intermittently positions at which the first spring-support is mountably locked on the first member. Thereby equivalent spring biasing pressures are available for window frames of different lengths or widths. For the beneficial feature of the ability to optimize and maximize outwardly biasing force and pressure at which the oppositely mounted angular paint shield bite into the lower edges of the window frame trim and are held snugly against the window pane, the adjustable pressure by this particular pressure-adjusting lever is essential and critical to the benefits of this particular preferred embodiment.

In a fifth preferred embodiment as an improvement on the first preferred embodiment, the member having a third end and the second member forms a second linearly-elongated channel and includes a third end, and also forms a second open end at the third end with the second opening being continuous with the second linearly-elongated channel. Additionally in this improvement, the spring biasing structure(s) (and mechanisms thereof) further includes a second movable member mounted on the remaining one of the first and second paint-shield structure(s) (and mechanisms thereof) and the second movable member has a fifth end movably mounted and retainable within the second linearly-elongated channel. Additionally, the first end is retainable within the second linearly-elongated channel at the third end, and the first member is mounted on the remaining one of the first and second paint-shield structure(s) (and mechanisms thereof). Thereby the spring biasing structure(s) (and mechanisms thereof) bias(es) the one of the first and second paint-shield structure(s) (and mechanisms thereof) away from the remaining other one of the first and second paint-shield structure(s) (and mechanisms thereof). As an alternative to an adjustable pressure lever above-described, this particular dual separate springs affords the better of two worlds, affording critically minimum axially outward biasing pressure resulting from the compression of each, together with each spring being tailored in body cross-section of the spring metal together with its length, compressability, and the like to make available that minimumly required outwardly biasing force and pressure for each or either small window and large window with which this invention may be successfully utilized. Accordingly, the aforestated and hereinafter stated elements and arrangements for this embodiment are critical to the obtaining of the benefits of this particular preferred embodiment, as evidenced by substantial research and development.

In a sixth preferred embodiment as an improvement on the first preferred embodiment, there is the embodiment the same as that of the third embodiment.

In a seventh preferred embodiment as an improvement on the third preferred embodiment, there is the embodiment the same as that of the fourth preferred embodiment.

In an eighth preferred embodiment as an improvement on the broad generic invention aforestated, a separate handled third paint shield structure(s) (and mechanisms thereof) is provided in the nature of a composite. This third paint shield also preferably includes the minimal aforestated degrees of bottom (at its linear edges). Accordingly the third paint shield is adapted to be concurrently hand-pressed against an intermediate adjoining window pane portion. While the separate handled third paint shield structure(s) (and mechanisms thereof) is hand-held fitted into a substantially intermediate remaining third corner divergent from the diagonally opposite corners of an adjoining framing window frame, the adjoining window pane portions of the adjoining framing window frame at diagonally opposite corners thereof and at the remaining third corner are each and all concurrently protected paint-shieldable against accidental painting adjoining window pane portions. The third paint-shield structure(s) (and mechanisms thereof) likewise form a second substantially right-angled outer edge at up tom ore than 90 degrees relative to the third right-angle outer edges having an outwardly-directed edge of the predetermined thin edge thickness. Because as a practical matter, the substantially right angular flanges sometimes are limited in length for most frequent usages thereof, for larger windows the additional hand-held paint shield is desirable and beneficial to enable shielding of window frame trim intermediately between the adjacent corners which the shield devices do not otherwise cover. Thus, this greater combination makes possible the achieving of such additional benefits, being thus critical to obtaining the benefits of this particular embodiment.

A nineth preferred embodiment as an improvement on the fourth preferred embodiment, is the same as that of the eighth preferred embodiment.

A tenth preferred embodiment as an improvement on the fifth preferred embodiment, is the same as that of the eight preferred embodiment.

In an eleventh preferred embodiment as an improvement on the second preferred embodiment, the angle ranges between about 8 degrees and about thirty degrees, being the most optimum range for the aforestated critical angular positioning of the lower face edge portion of each of the oppositely biased shields, being thus further critical for such optimum results in being self supporting and in avoiding the accumulation and/or smearing of paint.

In a twelvth preferred embodiment as an improvement on the broad/generic invention, there is the same improvement as the eleventh preferred embodiment.

In a thirteenth preferred embodiment as an improvement on the eleventh preferred embodiment, the spring biasing means consists essentially of at-least one helically shaped axially elongated compression spring. Experimental development established this type of spring to achieve optimal and superior results in achieving aforestated objects, and thus is critical to the benefits of this preferred embodiment, particularly with regard to being self-supporting and in avoiding acccumulation of and/or smearing of paint by edges of each and/or either of the oppositely biased paint shields.

In a fourteenth preferred embodiment as an improvement on the broad/generic invention, there is the same improvement as the thirteenth preferred embodiment.

In a fifteenth preferred embodiment as an improvement on the broad/generic invention, each of said left and right bottom faces range in width from about ¼ inch to about 5 inches, and range in length from about 4 inches to about 30 inches. Additionally, the distance between the first and second right angle corners in a spring expanded state as biased mounted by the spring biasing structure (and mechanism thereof) between diagonally opposite corners of a frame mounting a pane, ranges from about 5 inches to about 30 inches. Experimental evidence has confirmed that optimal results are achieved in the foregoing objects, when the limitations of this embodiment are included, making them critical for this embodiment.

In a sixteenth preferred embodiment as an improvement on the thirteenth preferred embodiment, each of the left and right bottom faces range in width from about ½ inch to about 2 inches, and range in length from about 5 inches to about 9 inches. Additionally, the distance between the first and second right angle corners in a spring expanded state as biased mounted by the spring biasing mechanism between diagonally opposite corners of a mounting frame, ranges from about 11 inches to about 17 inches. For the same reason but optimized, the limitations here stated have proven to be critical for the same reasons stated in the foregoing paragraph.

In a seventeenth preferred embodiment as an improvement on the second preferred embodiment, the first member and the first linearly-elongated channel each range from about 5 inches to about 25 inches. To achieve optimal spring biasing pressure discussed above and hereinafter, the support structure and channel length fall within this preferred range.

In an eighteenth preferred embodiment as an improvement on the second preferred embodiment, the first member and the first linearly-elongated channel each range from about 6 inches to about 9 inches, for smaller window frames this range proving by experimentation to be optimum for the same reasons stated in the foregoing paragraph, and thus critical to this preferred embodiment.

In a nineteenth preferred embodiment as an improvement on the eleventh preferred embodiment, the predetermined edge thickness ranges from about 1/100 inch to about about 3/32 inch at the right and left lower edge portions. Thickness having been evidenced by experimentation to be a very important and controlling feature/element in the securing of a self-supporting arrangement and in the achieving of a tight fit avoiding or reducing the amount of potential residual paint that might otherwise result in smearing of the framed window pane especially during the painting or removal of the mounted paint shields, makes these limitations critical for the aforestated reasons for this preferred embodiment.

In a twentieth preferred embodiment as an improvement on the eleventh preferred embodiment, the predetermined edge thickness ranges from about 1/100 inch to about 3/64 inch at the right and left lower edge portions and at-least the right and left lower edge portions each consist essentially of substantially semi-flexible plastic. As the most optimal range, the limitations are critical to this embodiment for the same reasons stated in the foregoing paragraph.

In a twenty-first preferred embodiment as an improvement on the broad/generic invention, there is the same improvement as that of the twentieth preferred embodiment.

In a twenty-second preferred embodiment as an improvement on the third preferred embodiment, includes a pivot mechanism effecting pivotal mounting of the first movable member on one of said first and second paint shields, and for effecting pivotal mounting of the second movable member on a remaining one of the first and second paint shields, the first and second pivot mechanisms each including upwardly-extending handle structure of predetermined sufficient length and mass to enable grasping each handle with a hand enabling pressing the handles toward one-another to compress said spring-biasing mechanism during a mounting or removal of the first and second paint-shields to and from a mounted position between the diagonally opposite corners of a window frame.

In an alternate embodiment of the invention, the handled third paint shield may be used independently and separate from the aforestated oppositely-biased paint shield combination. Accordingly, the alternate embodiment as a combination includes a paint shield structure (and mechanism thereof), and a handle structure (and mechanism thereof) mounted on the paint shield structure. For this alternate embodiment, the structures and angles and the like are the same as described above for the improvement structure of the eighth embodiment, apart from not including the oppositely directed spring-biased shield previously described herein. This independent additional combination embodiment includes the single paint shield structure(s) (and mechanism thereof) for and being and adapated to be hand-pressed against a window pane corner portion while the handled paint shield structure(s) (and mechanism thereof) is hand-held fitted into a corner of an adjoining framing window frame. Thereby the paint shield structure(s) (and mechanism thereof) of this alternate embodiment is manually pressible in a flush state against the framing window frame in the corner of the framing picture frame whereby when mounted against the window pane corner portion, adjoining framing window frame at the corner is protectable against accidentally painting adjoining window pane portions at at-least the corner when shielded from a paint-carrying paint brush by the paint-shield structure(s) (and mechanism thereof) during a pain-ting of the adjoining framing window frame at the corner. The handled paint shield structure(s) (and mechanism thereof) forms a substantially right-angled outer edge with a substantially right-angle corner and the substantially right-angled outer edge having a right linear edge portion extending at up to a right angle to a left linear edge portion such that the substantially right-angled outer edge is conformable to a substantially right angle shaped corner of the framing window frame when downwardy pressed at the corner. The right-angle outer edge has an outwardly-directed edge of predetermined thin edge thickness sufficiently thin as to substantially not obstruct a paint brush thereabove when painting the window frame when the outwardly-directed edge and the first and second right angle corners are pressed concurrently against the corner and against a window pane framed by the framing window frame. The paint-shield structure(s) (and mechanism thereof) additionally includes first and second interconnected right and left flanges extending at up to a right angle to one-another. The right flange of the paint-shield structure(s) (and mechanism thereof) has a right bottom face including a right lower edge portion angled downwardly toward and culminating as the right linear edge portion, and the left flange of the paint-shield structure(s) (and mechanism thereof) having a left bottom face including a left lower edge portion angled downwardly toward and culminating as the left linear edge portion. Relative to a plane extending along each of and between the right and left linear edge portions, there is formed an angle with each of said right and left lower edge portions, the angle ranging from about 5 degrees to about 55 degrees. The aforestated handle structure(s) (and mechanism thereof) for mounting and including handle structure sufficiently rigidly onto the handled paint shield structure(s) (and mechanism thereof) such that downwardly pressure on the handle structure is adapted to flex and hold the right and linear edge portions against the window pane portions and against the framing window frame at the corner when the outwardly-directed edge and the first and second right angle corners are pressed concurrently against the corner and against a window pane framed by the framing window frame.

In a twenty-third preferred embodiment as an improvement on the aforestated alternate embodiment, the ranges between about 8 degrees and about thirty degrees.

In a twenty-fourth preferred embodiment as an improvement on the twenty third preferred embodiment, each of the left and right bottom faces range in width from about ¼ inch to about 5 inches, and range in length from about 4 inches to about 30 inches.

In a twenty-fifth preferred embodiment as an improvement on the twenty-fourth embodiment, the predetermined edge thickness ranges from about 1/100 inch to about 3/32 inch at the right and left lower edge portions.

In a twenty-sixth preferred embodiment as an improvement on the twenty-fifth preferred embodiment, the predetermined thickness ranges from about 1/100 inch to about 3/64 at the right and left lower edge portions and at-least the right and left lower edge portions each consist essentially of steel.

In a twenty-seventh preferred embodiment as an improvement on the twenty-sixth preferred embodiment, the first and second interconnected right and left flanges are semi-rigid with minor flexibility sufficient that downward pressure on the handle structure causes the first and second interconnected right and left flanges to spread in a forward direction toward framing structure of the corner while concurrently the right and left edge portions relative to one another tend to spread to greater than ninety (90) degrees such that when the corner is ninety or more degrees, the right and left edge portions are pressed thereagainst.

In a twenty-eighth preferred embodiment as an improvement on the aforestated alternate invention, there is the same improvement as the aforestated twenty-fourth preferred embodiment.

In a twenty-ninth preferred embodiment, as an improvement on the aforestated alternate invention,there is the same improvement as the aforestated twenty-fifth preferred embodiment.

In a thirtieth preferred embodiment, as an improvement on the aforestated alternate invention, there is the same improvement as the aforestated twenty-sixth preferred embodiment.

In a thirty-first preferred embodiment, as an improvement on the aforestated alternate invention, there is the same improvement as the aforestated twenty-seventh preferred embodiment.

The invention may be better understood by making reference to the drawings of the following Figures.

DETAILED DESCRIPTION OF THE INVENTION

The invention broadly is directed to a window frame self-supporting window-pane paint shield constructed as aforestated to achieve the foregoing objects.

Figure 1:
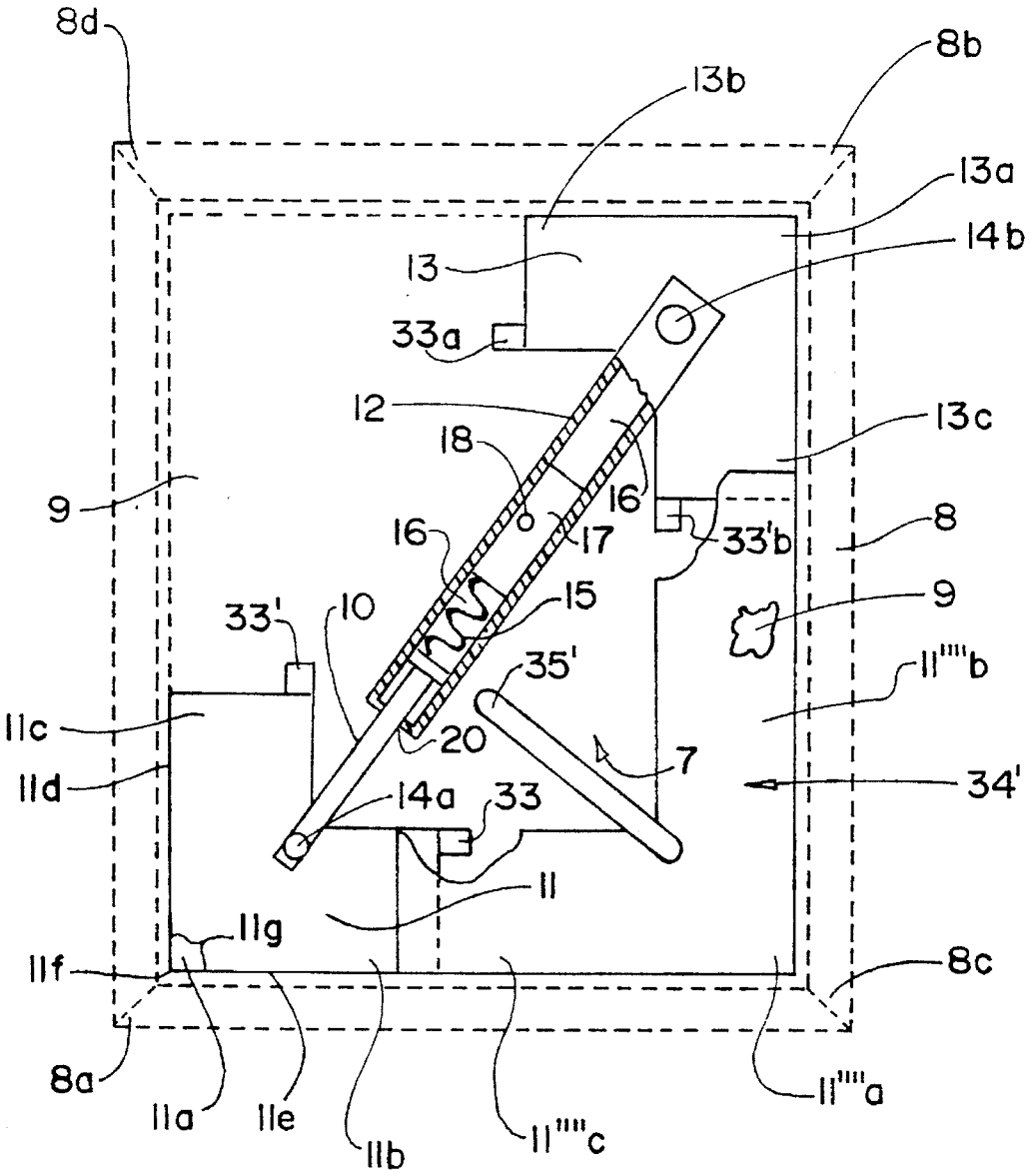
FIG. 1 diagrammatically and symbolically illustrates a framed window shown in phantom with mounted window pane glass thereof mounted therein, having an embodiment of the invention mounted on the glass self-supportingly biased between diagonally opposite right angular corners of the window frame, the windowpane paint shield device being shown in elevation plan view with partial cross-section, and also shown in combination is an accessory hand held paint shield shielding trim between the adjacent shielded opposite corners.

To better understand the invention in different embodiments thereof as typically shown by the drawings of the foregoing Figures, FIG. 1 illustrates the typical position of mounting any one of the illustrated embodiments flatly against a window pane and self-supportingly resulting from biasing force in opposite directions serving to lock the paint shield device against the framing structure of the window at each of opposite ends of the paint shield device. Accordingly, the FIG. 1 illustration is representative of the mechanism and positioning during mounting such that any of the embodiments encompassed is self-supporting.

Figure 2A:
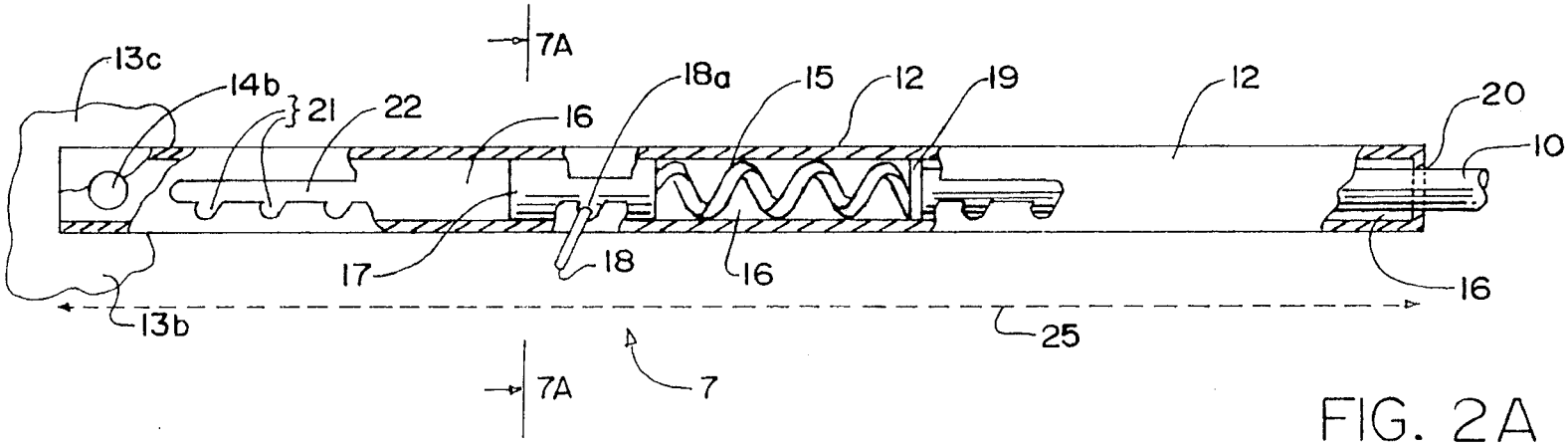
FIG. 2A diagrammatically and symbolically illustrates the same embodiment as that of FIG. 1 in partial cross-sections of different elements thereof, shown in an elevation plan view.

The FIG. 1 illustrates the mounting of the embodiment of device 7 of FIG. 2A. The pane framing structure 8 rises above the pane level of the window pane 9, the pane framing structure 8 in a conventional position affording structure against which the paint shield element 11 at one end is biased and against which at a diagonally opposite location the paint shield element 13 is biased when pressed against the window pane 9 as axially-extending shaft member 10 is axially biased by spring 15 that is held in place by the locked intermittently lockable adjustable slide-member 17 when the laterally-protruding lever 18 is rigidly mounted on and protruding from the adjustable slide-member 17. The adjustable slide member 17 is mounted slidably axially within the channel space 16 of channel-containing member 12, having its doughnut shaped key-retainer member 20 for retaining a retainer end-member or key 19. While the opposite-end paint shield elements 11 and 13 are substantially if not totally identical to one another in their respective structure(s) and shapes thereof, both at their separate outer circumference linear edges 11*d* and 11*e* converge at point 11*f* to form a right (90 degree) angle 11*g* that fits a correspondingly shaped window corner of 90 degrees. For the paint shield structure 11, pin 14*a* pivotally fastens the paint shield structure 11 to an end of the axially-extending shaft member 10 with its retainer end-member or key 19, and likewise the pin 14*b* at the end 18*a* of the laterally-protruding lever 18 pivotally fastens the lever 18 to the paint shield 13. The pivotal joining of the paint shield structures 11 and 13 each respectively, serves to enable the right-angular edges 11*d* and 11*e* to fit a right angle frame corner 11*a* for rectangularly shaped frame structure and rectangular window panes framed by the rectangular window frame structure, noting that the FIG. 1 illustrates a rectangular window pane and a rectangular window pane framing structure 8 having its identified typical corner-forming portions 8*a* and 8*b* and 8*c*. Additionally the pins 14*a* and 14*b* extend upwardly and serve as handles for grasping, one with the left hand and the other with the right hand, for pressing toward one-another slightly, while lifting the entire device from its wedge-mounted position and state of window pane shielding between the diagonally opposite corners.

The paint shield 11 of FIG. 1 has the right angular flange 11*b* and the opposite side's left angular flange 11*c*, jointly forming the right angle 11*g* at their joining point 11*f*. At the rearward outer edge of the right angular flange 11*b* is a downwardly-extending support leg 33, and likewise at the right angular flange 11*c* there is a corresponding downwardly-extending support leg 33'; these downwardly-extending legs 33 and 33' each serve to improve the pressure of the respective forward edges 11*d* and 11*e* against the window when concurrently spring-biased against the adjoining framing edge of the window frame structure 8. Other structure(s) such as rigidly-mounted downwardly-extending pins or the like, may equivalently be utilized with or instead of the legs. Likewise, for similar functions, paint shield 13 includes its downwardly-extending legs 33*a* and 33'*b* (see FIGS. 3 and 4 for the legs) and foot-flanges 33 and 33', and likewise the paint shield 13 has has its corresponding angular flanges 13*a* and 13*b*. The hand shield 34' having handle 35', has its respective angular flanges 11""*b* and 11""*c* overlapping respectively angular flanges 11*b* and 13*c* and corner window-pane space therebetween at its corner 11""*a*.

The FIG. 1 tubular and/or channel-defining member 12 includes an inwardly-extending flange 20 (above-noted doughnut shaped key-retainer member) positioned to engage and prevent exiting of the retainer member or key 19 of axially extending structure 10*a*, preventing it from exiting from space 16, as the spring 15 presses against the key 19 at one end of the spring 15, and presses against the adjustable intermittently lockable slide member 17 at the opposite end of the spring. The lockable slide member 17 is unlockable and moveable in either of opposite channel-sliding positions to alternately choose a greater biasing action or lesser biasing action against the key 19.

For FIG. 2A embodiment, apart from indicia already identified above, this top view (the same as FIG. 1) of embodiment 7, in elevation plan view of FIG. 2A additionally illustrates the elongated lever travel space 22 extending axially of channel-containing member 12 having a length 25. Adjacent thereto, the travel space-forming structure includes a series of angular sidewardly-directed slots 21 angled away from the spring position of spring 15. Thereby, at any desired position along the path of travel of the lockable slide member 17, the laterally protruding lever 18 may be moved into a desired slot 21 to a position at which desired spring biasing force of the spring 15 will be obtained relative to the distance over which the paint shield 11 and 13 are biased apart from each other in order to become bias wedged between opposite corners of frame structure of a window frame. The protruding lever is anchored within a hole 18*a* on the side of the lockable slide member 17. When biased axially, the axially extending member 10 is freely axially movable through free space formed adjacent the inwardly-extending flange 20 and through the channel space 16.

Figure 2B:
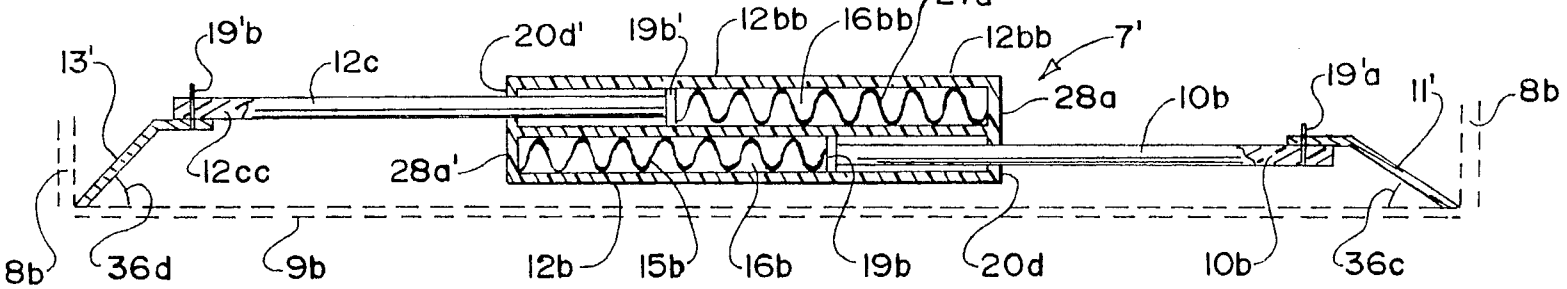
FIG. 2B diagrammatically and symbolically illustrates a different embodiment as a variation having two separate independent springs, also shown in partial cross-sections of elements thereof.

For the FIG. 2B embodiment 7', there are indicia corresponding to previously identified indicia such as space 16*b* corresponding to FIGS. 1 and 2A space 16, and likewise 19'*a*, 19'*b* and 19*b*' correspond substantially in function to the FIGS. 1 and/or 2A embodiments for indicia 19, and likewise indicia 20*d* and 20*d*' corresponding to the indicia 20 of FIGS. 1 and 2A embodiment. The angles 36*a* through 36*d* correspond to the FIGS. 1 and 2A angle illustrated in FIG. 4. Accordingly, similar indicia reflect identical or equivalent functions and data as previously described for each. Additionally there is a second channel forming structure 12*bb* continuous with and/or fixedly rigidly attached to the previously identified structure 12*b* (corresponding to previously identified structure 12). The channel forming structure 12*bb* forms axially-extending channel space 16*bb* in which is axially mounted therein a second spring 27*a* biased between stationary support 28*a* and the key 19*b* of axially moveable elongated member 12*c* of which the end 12*cc* thereof mounts the paint shield 13'. In like manner, the channel forming structure 12*b* embodies or has rigidly connected or anchored spring support structure 28*a*', such that the spring 15*b* is biased between the key 19*b* and the spring support structure 28*a*'.

Figure 2C:
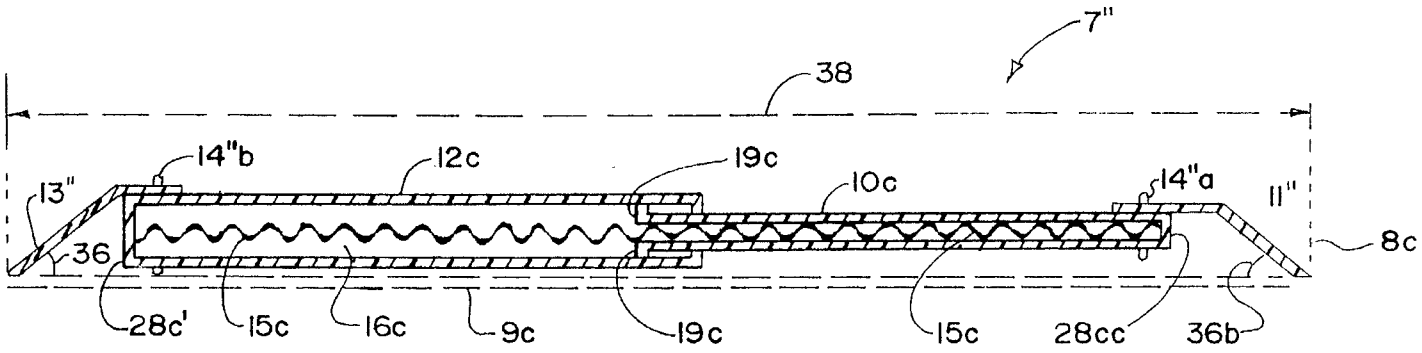
FIG. 2C diagrammatically and symbolically illustrates a different embodiment as a variation having one devoid of a tension-adjustment member, with the spring being arranged differently, also shown in partial cross-sections of elements thereof.

FIG. 2C embodiment 7" having a single spring, corresponds to the embodiment of FIG. 2A, but devoid of an adjustable slide member, and having an elongated spring biasing directly against a fixed abutment 28*c*' of the channel-forming structure 12*c*, and at an opposite end of the spring 15*c* biasing against the fixed abutment 28*cc*' of axially biased member 10*c* that is movable into and within chamber space 16*c* of channel-forming structure 12*c*.

Figure 3:
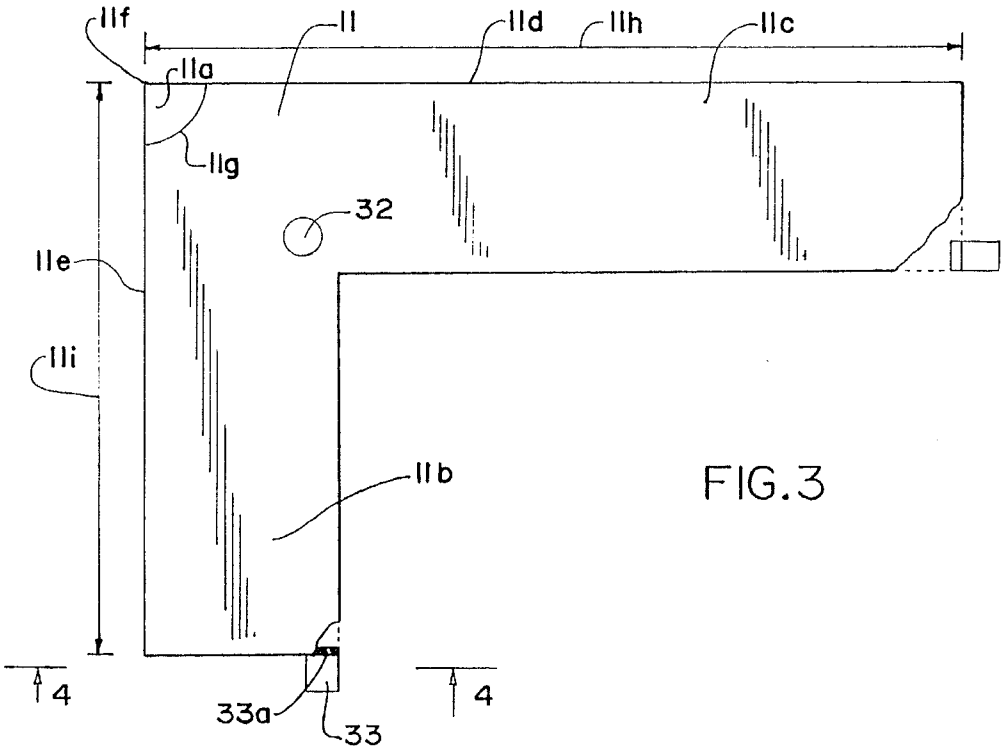
FIG. 3 diagrammatically and symbolically illustrates the frame-corners-fitting paint shield element typically shown in FIGS. 1, 2A, 2B, 2C and 2D, shown in enlargement in elevation plan view thereof, partial cutaway and in a dismounted state.

FIG. 3 illustrates in enlarged view, the dismounted paint shield 11, illustrating the previously identified corner 11*a* having right angle 11*g* of 90 degrees at corner-point 11*f* formed by converging edges 11*d* of flange 11*c* and 11*e* of flange 11*b* as aforestated above, and showing the typical pivotal pin-mounting through-hole 32. Angular flanges 11*b* and 11*c* respectively have lengths 11*i* and 11*h* respectively. Also legs 33*a* and 33'*b* (in cross-section) and foot-flanges 33 and 33' are shown.

Figure 4:
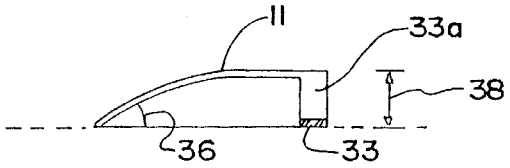
FIG. 4 diagrammatically and symbolically illustrates an end view in partial cross-section as taken along line 4—4 of FIG. 3.

FIG. 4 illustrates a side view as taken in cross-section through the leg 33*a* as taken along line 4—4 of FIG. 4, showing the typical appearance and shape of the paint shield 11 with its right angular flange 11*a* and its left angular flange 11*b*. This Figure also illustrates the angle 36—that is the angle of the FIG. 2A embodiment and the FIG. 1 embodiment for the angular flanges 11*b* and 11*c* of the paint shield structure 11, with its corner 11*a*.

Figure 5:
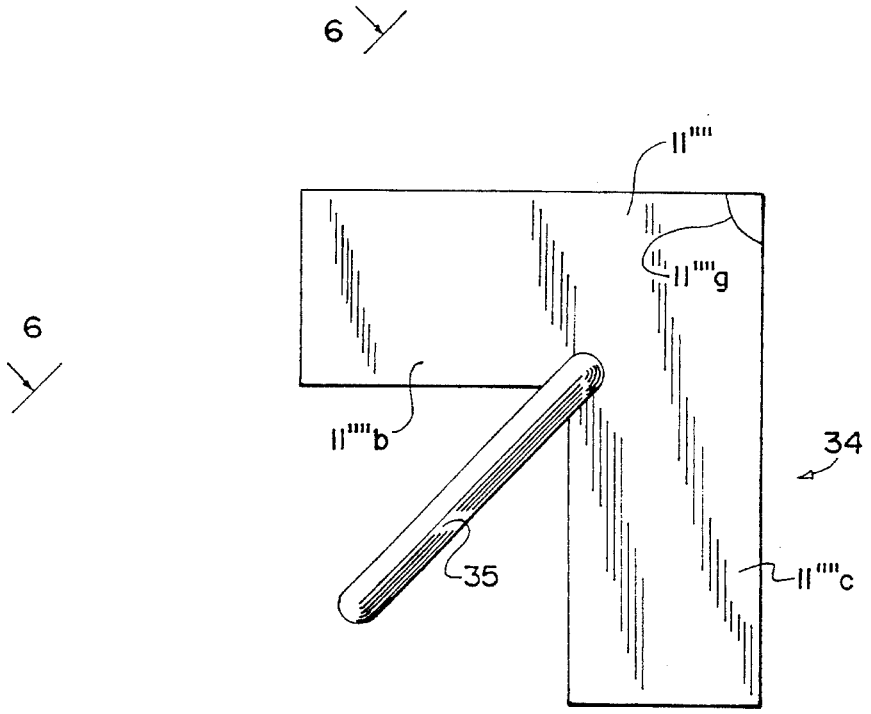
FIG. 5 diagrammatically and symbolically illustrates an accessory hand held paint shield constituting an alternate invention or constituting greater or larger combination or kit when taken with one or more of foregoing embodiments, this accessory paint shield being here shown in elevation plan view.

In the nature of a kit, or of an alternate embodiment in which the FIG. 5 handled paint shield above described, FIG. 5 illustrates a hand-holdable paint shield 34 with angular flanges 11"" corresponding in shape substantially to the paint shield 11, but being inclusive of a hand-holdable handle 35, for use for easy painting of the frame structure remaining exposed at an intermediate frame trim corner 8*c* between previously illustrated corners 8*a* and 8*b* of FIG. 1, when one of the embodiments is mounted in the position and manner illustrated for FIG. 1. The shape and dimensions and angles and the like are identical to those described or to be described for the oppositely-biased paint shields of this disclosure.

Figure 6:
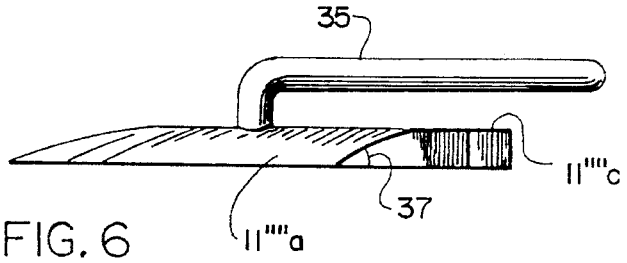
FIG. 6 diagrammatically and symbolically illustrates a side view along line 6—6 of FIG. 5.

FIG. 6 further illustrates the hand-holdable shield 34 and handle 35 thereof in a side view taken along line 6—6 of FIG. 5. In this view, the top face of paint shield 11""*bb* may be seen, and the underside of paint shield left flange 11""*c* may be seen. Also angle 37 thereof is illustrated and corresponds to angles 36*a*, 36*b*, 36*c* and 36*d* of embodiments of FIGS. 2B and 2C, noting that the corresponding angles of the embodiment of FIG. 2A and the angle 36 of the FIGS. 3 and 4 embodiment, also correspond to the foregoing angle in the broad and preferred ranges thereof and positions illustrated.

Figure 7A:
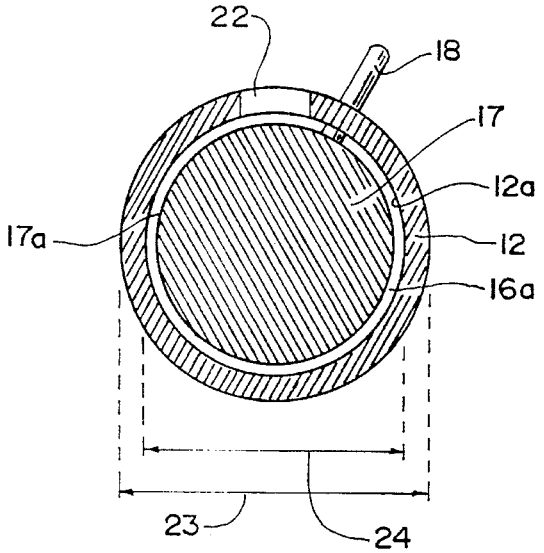
FIG. 7A diagrammatically and symbolically illustrates an in-part cross-sectional view as taken along line 7A—7A of FIG. 2A.

FIG. 7A illustrates a cross-sectional view as taken along line 7A—7A of FIG. 2A, illustrating elements previously identified, as well as showing the typically solid state of the lockable slidably adjustable slide-member 17 and its laterally protruding lock lever 18 shown in a locked state and position, illustrating the rounded cross-section of the slide-member 17. The outer diameter 23 of the tubular structure of structure 12, is illustrated, as well as its inner diameter 24, noting that an outer diameter of the slide-member 17 is less than the inner diameter 24. Space 16*a* here located between the outer surface 17*a* of the slide-member 17 and the inner surface of cylinder member 12 serves to typically illustrate that the adjustable slide-member 17 has sufficient space 16*a* to slide and to be revolved therein.

It should be noted that in the embodiment 7 of FIGS. 1 and 2A that includes the intermittently lockable slidably adjustable slide-member, for the slot-locking mechanism above-described, it is required that the cross-sectional shape of the slide-member and/or of the inside channel face of channel-forming member 12, be such as to allow the protruding lock lever to rotate laterally sufficiently to become engaged in the slot-locking structure or the like; in the present instance of embodiment 7, such is achieved by the cross-section being round, as shown in FIG. 7A. However, for other embodiments, squared or other multisided cross-section is acceptable and preferred, to prevent the accidental twisting of the outwardly-biased paint shields 11 and/or 13 and the like for the various embodiments.

While the paint shields 11 and 13 and the like have been illustrated as inclusive of the downward-extending support legs 33 and the like, and while such is/are desirable and beneficial for more flexible type materials and/or thicknesses thereof, increased thickness and/or greater rigidity of the particular material employed in the making of the paint shields themselves, whether plastic or some sort of metal, reduces and/or eliminates the necessity of such downwardly-extending support legs. Steel, as previously stated, is the preferred metal out of which the paint shields and right and left flanges thereof is formed, normally in a plated form, such as typically but not limited to chromium plated primarily for protection and decorative purposes. The steel is preferred on the basis of its large and greater strength as compared, for example, to normally weaker metals such as aluminum (normally anodized) or alloy(s) thereof, characterized by a significantly lesser strengh(s), and/or as compared to plastic which is even weaker in strength as compared to either aluminum or steel. The greater strength of steel as the preferred metal of the paint shields and right and left flanges thereof, improves the retention of the above-discussed critically present angle/degrees essential to the proper functioning of the framed window-pane paint shield device of this invention. The embodiments made, for example of plastic, would require much thicker plastic and/or the leg flanges discussed above as a part of the shield flanges, to prevent the bending of the flanges when subjected to the large forces of the biasing spring(s) by which the first and second paint shields are wedged between diagonally opposite corners of the framing trim mounting the glass pane. The hand-held "plastic" shield 34 is typically slightly flexible plastic such as polyvinyl chloride, polystyrene, or other equivalent sturdy plastics, for the paint shields and/or for the channel forming structure and/or for the axially-extending shaft member. Aluminum could be made at in a thinner state, with comparable strength of a thicker sheet of plastic, for example. Likewise, the flange thickness, as well as the edge thickness of the right-angled linear edges of the paint shield for hand-held shield 34 is of sufficient thinness and flexibility as to permit a less-than-90 degrees shield-corner to expand to ninety or more degrees as might be required for a particular edging corner to provide wedging fit adjacent the glass pane, and thus not interfering with painting the lower portions of the trim closely adjacent to the glass pane. For the non-hand held paint shields, the thinner steel makes greater spring biasing force available devoid of bending the flanges and with an improved preventing any discernible nor significant amount of paint adacent to nor onto the glass pane, thereby further reducing the possibility or probability eventually accidentally smearing the glass when moving or removing the paint shield device and paint shields thereof.

It will be noted with reference to FIG. 1 that the hand-held paint shield is intermittently utilizable at each of the right bottom and before or thereafter at the left top corner of a rectangular window that has a window height greater than its window width; such would be a required hand-held paint shield respective positioning of the upright angular flange 11""*b* to the right of the bottom angular flange 11""*c*. The sole reason this would be necessary is that the paint shield embodiment 7 has the shield structure 11 in the bottom left corner and the shield structure 13 in the right top corner. On the other hand, the FIGS. 5 and 6 hand shield embodiment would be utilizable in in combination with the embodiment 7 shields of FIG. 1, solely if and when the embodiment 7 typically utilizes the shield structure 11 in the right bottom corner of the FIG. 1 window frame with the structure 13 in the left top corner of the FIG. 1 window frame. The difference of proper place of use depends upon whether the hand-held paint shield is that illustrated in FIG. 1 or alternatively its mirror image, namely the FIGS. 5 and 6 hand-held paint shield embodiment.

Accordingly, for any one or more of the embodiments of FIGS. 1 through 4 and 7, prior to beginning the painting of the frame (frame trim) 8, the embodiment 7 is placed by the painter-operator into its wedged state and position by hand-holding in opposite hands in a pushed-together (against spring biasing action) the axially-extending shaft member 10 in one hand and the channel-containing member 12 in the other hand, while positioning the angular paint shield 11 in the right left bottom corner (if to be used with the hand-held paint shield 34') and concurrently while positioning the angular paint shield 13 in the top right position as shown in FIG. 1. On the other hand, if the hand-held shield 34 is to be utilized, while pushing together the axially-extending shaft member 10 and the channel-containing member 12, the paint shield 11 would be placed in the right bottom at the 8*a* location/position (or alternatively at a top left) for the window frame illustrated in FIG. 1 and the paint shield 13 would be placed in the left top at 8*b* location/position (or alternatively at a right bottom) of the window frame illustrated in FIG. 1. Typically for the FIG. 1 combination embodiment illustrated to include the hand-held paint shield 34', when paint is on a paint brush ready for painting, typically a majority of the window frame trim at locations/positions 8*a* and 8*b* either before or after the painting thereafter the hand-held paint shield 34' is picked-up and held in the other hand and placed in the position overlapping the angular shield flanges 11*b* and 13*c*, enabling painting of the 8*c* location ranging up to the angular flanges 11*b* and 13*c*. Thereafter, the hand-held paint shield 34' is lifted away from the glass and position 8*c*, and moved to location/position 8*d* for the final painting, namely of that portion of the frame trim followed by again removal of the hand-held paint shield 35' and thereafter removal of the paint-shield 7 in a direction outwardly and away from the shielded window pane.

For the alternate embodiment claimed herein for the handled paint shield, it is within the scope of the invention to anchor the handle in a downwardly pressed position and state, by may suitable and/or conventional mechanism, such as typically having a suction cup attached thereto which by suction will hold to the glass of the framed window being or to be painted, with the advantage that this handled alternate embodiment is thereby also attachable in a self-supporting manner, devoid of continuous use of supporting hand(s).

It is within the scope of the invention to make such variation(s) and/or substitution(s) of equivalents as would be within the skill of an ordinary artisan in this particular art of window frame or window frame trim painting.

I claim:

1. A portable window paint shield for being pressed against an adjoining window pane portion in combination, consisting of: a paint shield means for being hand-pressed against a window pane corner portion while the paint shield means is hand-held fitted into a frame corner of an adjoining window frame such that the paint shield means is manually pressible in a flush state against the window frame in said frame corner when mounted against the window pane corner portion and such that adjoining framing window pane portions at at-least the frame corner when shielded from a paint-carrying paint brush by the paint shield means during a painting of the adjoining window frame at said frame corner, the paint shield means forming a substantially right-angled outer edge with a substantially right-angle corner and the substantially right-angled outer edge having a right linear edge portion extending at up to a right angle to a left linear edge portion such that the substantially right-angled outer edge is conformable to a substantially right angle shaped corner of the window frame when downwardly pressed at the frame corner; the right-angled outer edge having an outwardly-directed edge of a predetermined edge thickness of sufficient thinness to substantially prevent obstruction of a paint brush thereabove when painting the window frame when the outwardly-directed edge and the right angle corner of this paint shield means are pressed concurrently against the substantially right angle shaped corner of the window pane in the window frame, said paint-shield means including first and second interconnected right and left flanges extending up to a right angle to one-another, the right flange of the paint-shield means having a right bottom face including a right lower edge portion angled downwardly toward and culminating as said right linear edge portion, and the left flange of said paint-shield means having a left bottom face including a left lower edge portion angled downwardly toward and culminating as said left linear edge portion; and relative to a plane extending along each of and between said right and left linear edge portions, there being formed an angle with each of said right and left lower edge portions, said angle ranging from about 5 degrees to about 55 degrees; and a handle means rigidly mounted on said paint shield means such that said right and left linear edge portions are pressable against said window pane portion and against said window frame at said frame corner when the outwardly-directed edge and the right angle corner are pressed concurrently against said frame corner and against a window pane framed by the window frame, said first and second interconnected right and left flanges being semi-rigid with sufficient flexibility that downward pressure on said handle means causes said first and second interconnected right and left flanges to spread in a forward direction toward framing structure of said frame corner while concurrently said right and left linear edge portions relative to one another tend to spread to greater than ninety (90) degrees such that when said frame corner is ninety or more degrees, said right and left linear edge portions are pressed thereagainst, and each of said left and right bottom faces ranging in width from about ¼ inch to about 5 inches, and ranging in length from about 4 inches to about 30 inches.

2. The portable window paint shield of claim 1, in which said angle ranges between about 8 degrees and about thirty degrees.

3. The portable window paint shield of claim 2, in which said predetermined edge thickness ranges from about 1/100 inch to about about 3/32 inch at said right and left lower edge portions.

4. The portable window paint shield of claim 3, in which said predetermined thickness ranges from about 1/100 inch to about 3/64 at said right and left lower edge portions and in which at-least said right and left lower edge portions each consist essentially of steel.

5. The portable window paint shield of claim 1, in which said predetermined edge thickness ranges from about 1/100 inch to about 3/32 inch at said right and left lower edge portions.

6. The portable window paint shield of claim 1, in which said predetermined thickness ranges from about 1/100 inch to about 3/64 at said right and left lower edge portions and in which at-least said right and left lower edge portions each consist essentially of steel.

* * * * *